US010242509B2

(12) United States Patent
Throop et al.

(10) Patent No.: US 10,242,509 B2
(45) Date of Patent: Mar. 26, 2019

(54) EFFICIENT TELEMATICS DATA UPLOAD

(71) Applicant: Ford Global Technologies, LLC, Dearborn, MI (US)

(72) Inventors: Medville Jay Throop, Ann Arbor, MI (US); Leighton Barnes, Somerville, MI (US); Douglas B. Thornburg, Dearborn, MI (US); Brian David Tillman, Dearborn, MI (US); John William Schmotzer, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 475 days.

(21) Appl. No.: 14/594,520

(22) Filed: Jan. 12, 2015

(65) Prior Publication Data

US 2016/0203652 A1 Jul. 14, 2016

(51) Int. Cl.
*G07C 5/00* (2006.01)

(52) U.S. Cl.
CPC ..... *G07C 5/008* (2013.01)

(58) Field of Classification Search
CPC ..... G07C 5/008
See application file for complete search history.

(56) References Cited

U.S. PATENT DOCUMENTS

| | | | | |
|---|---|---|---|---|
| 6,636,790 | B1 * | 10/2003 | Lightner | G01M 15/102 701/31.4 |
| 7,010,289 | B2 | 3/2006 | Jijina et al. | |
| 8,139,820 | B2 | 3/2012 | Plante et al. | |
| 2008/0294302 | A1 * | 11/2008 | Basir | G01C 21/20 701/2 |
| 2011/0130905 | A1 * | 6/2011 | Mayer | G07C 5/008 701/22 |
| 2012/0004804 | A1 * | 1/2012 | Beams | G01S 5/0027 701/32.7 |
| 2013/0154854 | A1 | 6/2013 | Chen et al. | |
| 2013/0162425 | A1 | 6/2013 | Raghunathan et al. | |
| 2013/0282228 | A1 * | 10/2013 | Cawse | G07C 5/085 701/32.2 |

FOREIGN PATENT DOCUMENTS

KR 20100045152 A 5/2010

* cited by examiner

*Primary Examiner* — Imran K Mustafa
(74) *Attorney, Agent, or Firm* — Frank L. Lollo; Brooks Kushman P.C.

(57) ABSTRACT

A vehicle electronic control unit (ECU) may control a vehicle subsystem and be configured to receive from a remote server via a vehicle telematics unit (TCU), a parameter definition of a processed parameter to be computed by the ECU; generate the processed parameter according to the parameter definition based on a raw parameter generated by the ECU; and send the processed parameter to a vehicle data buffer associated with the ECU for upload to the remote server via the TCU.

17 Claims, 5 Drawing Sheets

EFFICIENT TELEMATICS DATA UPLOAD

TECHNICAL FIELD

Aspects of this disclosure generally relate to a method and apparatus for the efficient providing of telematics data from vehicles.

BACKGROUND

Vehicle telematics units may be utilized to allow a user of a vehicle to interact with services available over a communications network. These services may include turn-by-turn directions, telephone communications, vehicle monitoring, and roadside assistance. In some vehicles, telematics features may be used to provide vehicle diagnostic and other data to a remote cloud server, but with limited data content and reporting intervals.

SUMMARY

In a first illustrative embodiment, a vehicle system includes a vehicle electronic control unit (ECU) controlling a vehicle subsystem and configured to receive from a remote server via a vehicle telematics unit (TCU), a parameter definition of a processed parameter to be computed by the ECU; generate the processed parameter according to the parameter definition based on a raw parameter generated by the ECU; and send the processed parameter to a vehicle data buffer associated with the ECU for upload to the remote server via the TCU.

In a second illustrative embodiment, a vehicle includes a plurality of electronic control units (ECUs), each configured to generate processed parameters according to received parameter definitions; a telematics control unit (TCU) configured to provide a data stream of the processed parameters to a remote server; and a plurality of vehicle data buffers, each configured to receive the processed parameters from the plurality of ECUs and send the processed parameters to the TCU over a dedicated data-reporting vehicle network.

In a third illustrative embodiment, a computer-implemented method includes receiving from a remote server via a vehicle telematics unit (TCU), a parameter definition of a processed parameter to be computed by the ECU; generating the processed parameter according to the parameter definition based on a raw parameter generated by the ECU; and sending the processed parameter to a vehicle data buffer associated with the ECU for upload to the remote server via the TCU.

DETAILED DESCRIPTION

Figure 1:
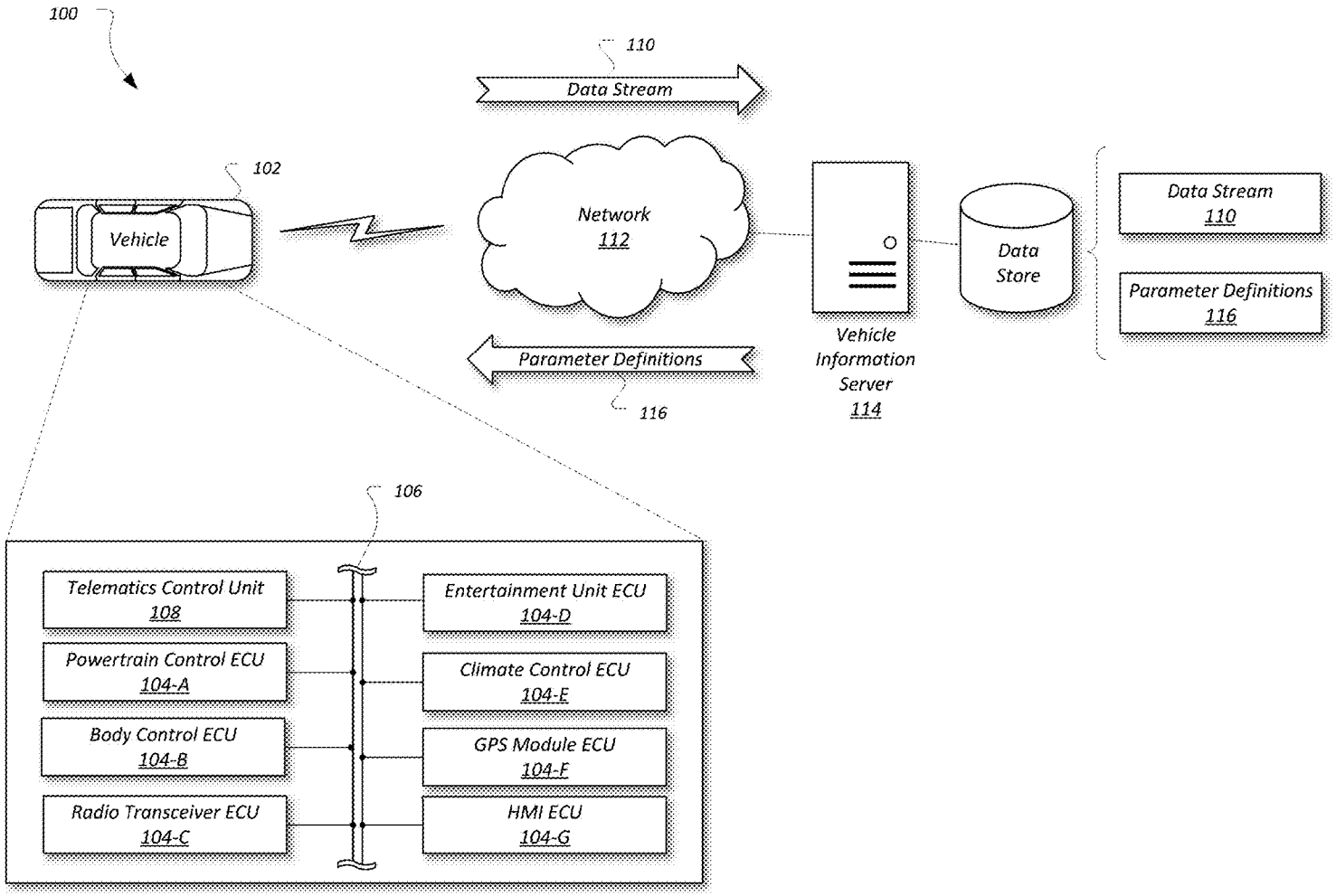
FIG. 1 illustrates an example vehicle implementing telematics data collection features.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Vehicle data reporting architectures, and software/firmware updates of data reporting applications, may be utilized to facilitate efficient, automatic, and reconfigurable vehicle data processing and uploading of data to a vehicle information server. During vehicle operation, a predefined data set of raw ECU parameters may be collected, processed, and stored in memory on each vehicle electronic control unit (ECU). Based on the collected raw parameters, available data sets may be extracted from the ECU memory locations, further processed if necessary by configurable reporting applications executed by the ECU, and forwarded to the vehicle information server as a data stream. Once the processed data stream has been uploaded, it may be saved in a vehicle information database for further analysis. According to the analysis, the vehicle information server may support implementation of a service action, providing of an automatic software update to the vehicle, or providing a request to reconfigure additional data streams from the vehicle to facilitate additional in-depth analysis.

Data reporting from a vehicle may be triggered by events which may be either internal to the vehicle or from an external source such as the vehicle information server. If the trigger event originates external to the vehicle, a unique vehicle identifier (such as a VIN) may be sent from the vehicle to the vehicle information server to retrieve specific information regarding which ECUs and associated software versions are on the vehicle and accordingly which data streams can be provided.

Each ECU may be configured to provide a standard list of raw parameters. A list of these available raw parameters and their associated information may be stored in the vehicle information database. By identifying which ECUs are in the vehicle, the system may be able to identify which raw parameters are available to be processed into data streams to be provided to the vehicle information server. If the requested processed data streams are unavailable, but the raw parameters to produce it are available, the appropriate ECUs may be reflashed or otherwise reprogrammed with updated data reporting applications configured to produce the requested data stream. If a request for data is unsupported by the ECUs of the vehicle (e.g., it requires as an input a raw parameter that is not provided by the ECUs), a request-not-supported message may be returned to the vehicle information server.

The resulting collected data stream may be forwarded to the vehicle information server for analysis. In an example, the processed parameters computed by the reporting applications of the ECUs, along with identifying information and/or timestamps for the processing, may be buffered until requested by a collection trigger. For instance, the processed parameters from each ECU may reside within a dedicated buffer representing an individual data stream.

The vehicle data reporting architectures may include subsystems on the vehicle network configured to process data prior to upload to the vehicle information server. Various vehicle data reporting architectures may be utilized to support the data functionality. An example reporting architecture may be implemented according to a decentralized subsystem approach, in which each ECU has its own, dedicated processing subsystem configured to provide the requested data from the ECU via a separate network node of the ECU. In another example, processed data may instead be sent to the telematics control unit via a separate vehicle bus (not necessarily a controller area network (CAN) bus) to avoid depleting base CAN bus bandwidth. By having separate network nodes or networks to facilitate data reporting, the vehicle data reporting architectures may adopt network and message identifiers which are consistent across vehicle lines without conflicting with other vehicle system operation. In yet another example, a centralized processing location, such as the telematics control unit, can execute processing and buffering of data streams sent from the vehicle ECUs.

Specifically-tailored reporting applications may be utilized to compress vehicle data prior to uploading. For example, a trace of an engine revolutions-per-minute (RPM) raw parameter which streams on a CAN bus can be low-pass filtered and then down-sampled while still retaining most of its information. When received, the original signal may be reconstructed with acceptable error once it has been uploaded. In another example, compression of vehicle data may be achieved with other processing (e.g. Fast Fourier Transforms). Other example algorithms that may be used by reporting applications may include, for instance, linear filtering, subsampling, peak detection, median filtering, min/max values, and matched filtering. Further aspects of the efficient provision of telematics data from vehicles are described in detail below.

FIG. 1 illustrates an example system 100 including a vehicle 102 implementing remote telematics data offload features. As illustrated, the vehicle 102 includes a plurality of vehicle ECUs 104 in communication over one or more vehicle buses 106. The vehicle 102 further includes a telematics control unit 108 configured to receive one or more parameter definitions 116 over a network 112 from a vehicle information server 114, configure the vehicle ECUs 104 to provide the information specified by the parameter definitions 116, collect the information specified by the parameter definitions 116 from the vehicle ECUs 104, and send data streams 110 including the specified information to the vehicle information server 114. It should be noted that the system 100 is merely an example, and other arrangements or combinations of elements may be used.

The vehicle 102 may include various types of automobile, crossover utility vehicle (CUV), sport utility vehicle (SUV), truck, recreational vehicle (RV), boat, plane or other mobile machine for transporting people or goods. In many cases, the vehicle 102 may be powered by an internal combustion engine. As another possibility, the vehicle 102 may be a hybrid electric vehicle (HEV) powered by both an internal combustion engine and one or more electric motors, such as a series hybrid electric vehicle (SHEV), a parallel hybrid electrical vehicle (PHEV), or a parallel/series hybrid electric vehicle (PSHEV). As the type and configuration of vehicle 102 may vary, the capabilities of the vehicle 102 may correspondingly vary. As some other possibilities, vehicles 102 may have different capabilities with respect to passenger capacity, towing ability and capacity, and storage volume. For title, inventory, and other purposes, vehicles 102 may be associated with unique identifiers, such as VINs.

The vehicle 102 may include a plurality of electronic control units (ECUs) 104 configured to perform and manage various vehicle 102 functions under the power of the vehicle battery and/or drivetrain. As depicted, the example vehicle ECUs 104 are represented as discrete ECUs 104-A through 104-G. However, the vehicle ECUs 104 may share physical hardware, firmware, and/or software, such that the functionality from multiple ECUs 104 may be integrated into a single ECU 104, and that the functionality of various such ECUs 104 may be distributed across a plurality of ECUs 104.

As some non-limiting vehicle ECUs 104 examples: a powertrain control ECU 104-A may be configured to provide control of engine operating components (e.g., idle control components, fuel delivery components, emissions control components, etc.) and for monitoring status of such engine operating components (e.g., status of engine codes); a body control ECU 104-B may be configured to manage various power control functions such as exterior lighting, interior lighting, keyless entry, remote start, and point of access status verification (e.g., closure status of the hood, doors and/or trunk of the vehicle 102); a radio transceiver ECU 104-C may be configured to communicate with key fobs, mobile devices, or other local vehicle 102 devices; an entertainment control unit 104-D may be configured to support voice command and BLUETOOTH interfaces with the driver and driver carry-on devices; a climate control management ECU 104-E may be configured to provide control of heating and cooling system components (e.g., compressor clutch, blower fan, temperature sensors, etc.); a global positioning system (GPS) ECU 104-F may be configured to provide vehicle location information; and a human-machine interface (HMI) ECU 104-G may be configured to receive user input via various buttons or other controls, as well as provide vehicle status information to a driver, such as fuel level info, engine operating temperature information, and current location of the vehicle 102.

The vehicle bus 106 may include various methods of communication available between the vehicle ECUs 104, as well as between the telematics control unit 108 and the vehicle ECUs 104. As some non-limiting examples, the vehicle bus 106 may include one or more of a vehicle controller area network (CAN), an Ethernet network, and a media oriented system transfer (MOST) network. Further aspects of the layout and number of vehicle buses 106 are discussed in further detail below.

The telematics control unit 108 may include network hardware configured to facilitate communication between the vehicle ECUs 104 and with other devices of the system 100. For example, the telematics control unit 108 may include a cellular modem configured to facilitate communication with the communications network 112. The network 112 may include one or more interconnected communication networks such as the Internet, a cable television distribution network, a satellite link network, a local area network, a wide area network, and a telephone network, as some non-limiting examples. As another example, the telematics control unit 108 may utilize one or more of Bluetooth, Wi-Fi, and wired USB network connectivity to facilitate communication with the communications network 112 via the user's mobile device. In an example, the telematics control unit 108 may be programmed to periodically collect information from the ECUs 104, package the information into data streams 110, and provide data streams 110 to the vehicle information server 114 over the communications network 112.

The telematics control unit 108 may be further configured to include one or more interfaces from which vehicle information may be sent and received. In an example, the telematics control unit 108 may be configured to facilitate the collection of vehicle information for inclusion in the data streams 110 from the vehicle ECUs 104 connected to the one or more vehicles buses 106. The vehicle information retrieved by the telematics control unit 108 may include, as some non-limiting examples, accelerator pedal position, steering wheel angle, vehicle speed, vehicle location (e.g., GPS coordinates, etc.), vehicle unique identifier (e.g., VIN), engine revolutions per minute (RPM), and vehicle HMI information, such as steering wheel button press information. Further aspects of the collection of vehicle information from the vehicle ECUs 104 are discussed in detail below.

The vehicle information server 114 may include various types of computing apparatus, such as a computer workstation, a server, a desktop computer, a virtual server instance executed by a mainframe server, or some other computing system and/or device. Computing devices, such as the vehicle information server 114, generally include a memory on which computer-executable instructions may be maintained, where the instructions may be executable by one or more processors of the computing device. Such instructions and other data may be stored using a variety of computer-readable media. A computer-readable medium (also referred to as a processor-readable medium or storage) includes any non-transitory (e. g., tangible) medium that participates in providing data (e.g., instructions) that may be read by a computer (e.g., by the processor of the vehicle information server 114). In general, processors receives instructions, e.g., from the memory via the computer-readable storage medium, etc., and executes these instructions, thereby performing one or more processes, including one or more of the processes described herein. Computer-executable instructions may be compiled or interpreted from computer programs created using a variety of programming languages and/or technologies, including, without limitation, and either alone or in combination, Java, C, C++, C#, Objective C, Fortran, Pascal, Visual Basic, Java Script, Perl, Python, PL/SQL, etc. In an example, the vehicle information server 114 may be configured to maintain the data streams 110 received from the telematics control unit 108 of the vehicles 102 by way of the network 112.

The vehicle information server 114 may be further configured to maintain parameter definitions 116 descriptive of the various elements of the data streams 110 that may be provided by the vehicles 102. The parameter definitions 116 may include a listing of information for each of the possible parameter, such as a global identifier of the particular parameter, a description of the type of data represented by the parameter (e.g., name), an identifier of a ECU 104 configured to provide the parameter, and details of the format of the data of the parameters (e.g., bitrate, scale, accuracy, precision). In some cases, the parameter definitions 116 may also include information regarding algorithms or other processing that may be used to configure the ECUs 104 to process the data streams 110 into the particular parameter definition 116. In an example, the parameter definitions 116 may include software or firmware that may be installed to and executed by the ECUs 104 to cause the ECUs 104 to become reconfigured to provide the particular parameter definition 116.

Variations on the system 100 are possible. In an example, instead of or in addition to use of the telematics control unit 108 to provide remote connectivity to the vehicle information server 114, the telematics control unit 108 may utilize communications features of a modem of a user's mobile device paired with the entertainment using ECU 104-D to perform communication over the communications network 112.

Figure 2:
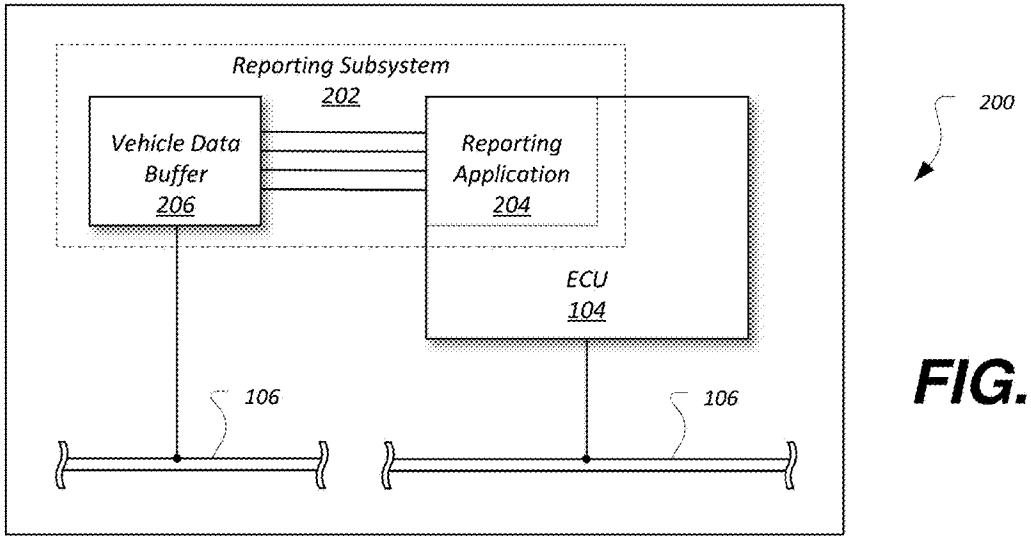
FIG. 2 illustrates an example diagram of a reporting subsystem of the system for one of the electronic control units of the vehicle.

FIG. 2 illustrates an example diagram 200 of a reporting subsystem 202 of the system 100 for one of the ECUs 104 of the vehicle 102. As illustrated, the reporting subsystem 202 includes a reporting application 204 executed by the ECU 104 and in communication with a vehicle data buffer 206 associated with the ECU 104. The ECU 104 may be configured to store the reporting application 204 to a programmable memory of the ECU 104. The ECU 104 may be further configured to be communicatively connected to one or more vehicle buses 106. While the buffer is illustrated as being logically separate from the ECU 104, it should be noted that the buffer 206 may include one or more memories either included within the ECU 104 and/or outside of the ECU 104. The buffer 206 may be further configured to be communicatively connected to one or more vehicle buses 106. Notably, the buffer 206 may not necessarily be connected to the same more vehicle bus 106 to which the ECU 104 is connected.

Figure 3:
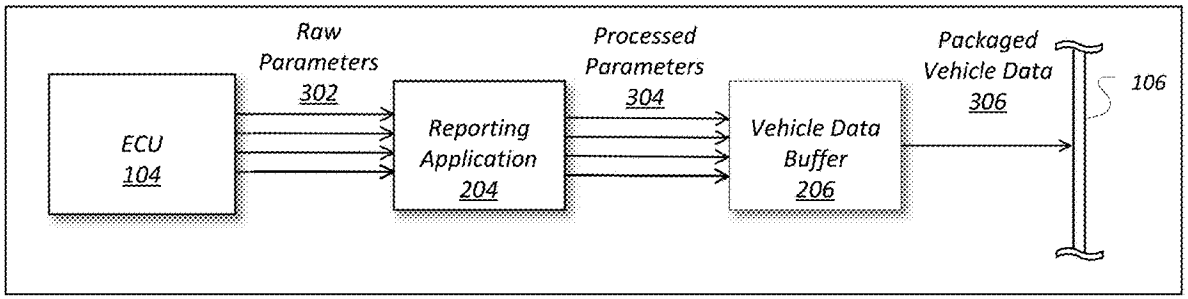
FIG. 3 illustrates an example diagram of processing of vehicle data by a reporting application for a reporting subsystem of the vehicle electronic control units.

FIG. 3 illustrates an example diagram 300 of processing of vehicle 102 data by the reporting application 204 of the reporting subsystem 202 of the ECU 104. As shown, raw parameters 302 may be provided by the ECU 104, such as according to the hardware of the ECU 104 and/or according to the firmware programming of the ECU 104. Thus, these raw parameters 302 may be relatively unchangeable by changes to the reporting application 204. Thus, an update to the provisioning of the raw parameters 302 may require a firmware update to the firmware of the ECU 104, not merely an update to the reporting application 204 that is configured to processes the raw parameters 302.

The reporting application 204 may be configured to receive the raw parameters 302 that are available from the ECU 104, and utilize various algorithms or functionality to process the raw parameters 302 into processed parameters 304. For instance, the reporting application 204 may be configured to compress the raw parameters 302 into processed parameters 304 which may include a data-compressed version of aspects of the raw parameters 302. In another example, the reporting application 204 may be configured to filter the raw parameters 302 into processed parameters 304 which include only a subset of the information of the raw parameters 302. Other example processing algorithms may include linear filtering, subsampling, peak detection, FFTs, median filtering, min/max values, and matched filtering. Each processed parameter 304 may be associated with an identifier, such as a unique identifier number of the parameter definition 116 associated with a processed parameter 304 to be provided by the ECU 104. A detailed example of conversion of a raw parameter 302 into a processed parameter 304 is discussed below with respect to FIG. 6.

Once processed, the reporting application 204 may be configured to provide the processed parameters 304 to the buffer 206. The buffer 206 may accordingly be configured to store the processed parameters 304 to be offloaded. In an example, the buffer 206 may store the processed parameters 304 in a structure including an identifier number of the parameter definition 116 identifying the processed parameters 304 being stored, a value of the processed parameter 304, and a timestamp (e.g., a collection time of the raw parameters 302 used to compute the processed parameter 304, of a starting or completion time of computation of the processed parameter 304, etc.). Responsive to triggering of reporting of the processed parameters 304, the buffer 206 may be configured to send a data unit or packet (e.g., a CAN frame) for each ID/value/time structure of each processed parameter 304 collected for the ECU 104. Accordingly, when executed by the ECU 104, the reporting application 204 may be configured to cause the ECU 104 to generate the processed parameters 304 specified by the parameter definitions 116, as well as to pass the processed parameters 304 to the buffer 206 for data collection.

The ECU 104 may be further configured to allow the reporting application 204 to be flashed with an updated reporting application 204, such as responsive to updated parameter definitions 116 received from the vehicle information server 114. In an example, the ECU 104 may be configured to receive the updated reporting application 204 via one or more vehicle bus 106 of the vehicle 102. The reporting application 204 may reside in a dedicated software location of the ECU 104, such that the reporting application 204 may be updated efficiently by a differential update, without affecting the other programming of the ECU 104.

Figure 4:
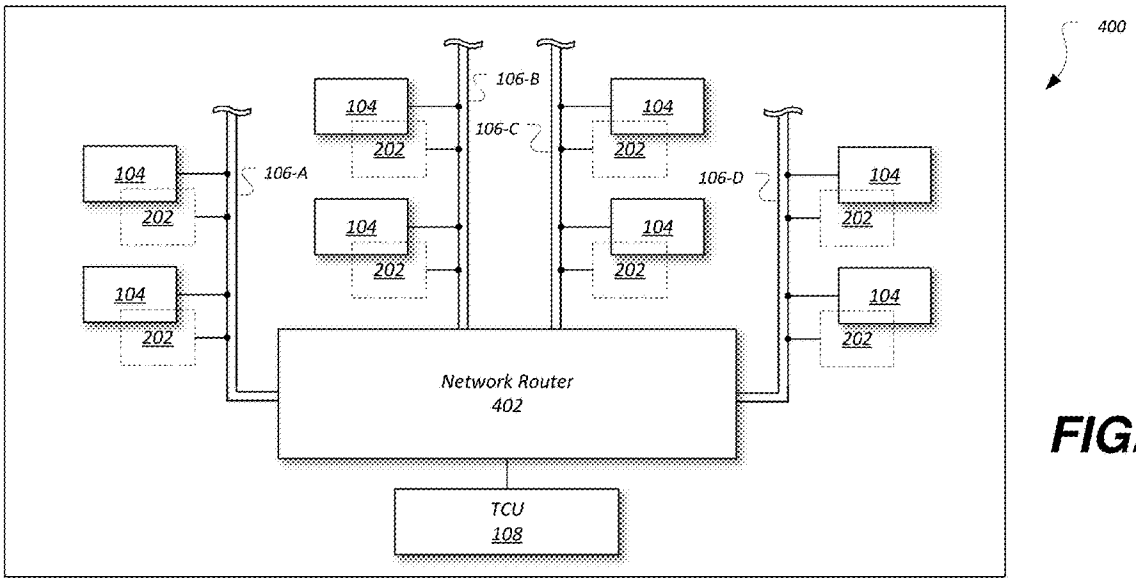
FIG. 4 illustrates an example diagram of a network architecture for the vehicle including data reporting subsystems utilizing the same vehicle networks as utilized by the electronic control units.

FIG. 4 illustrates an example diagram of a network architecture 400 for the vehicle 102. In the example network architecture 400, the data reporting subsystems 202 utilize the same vehicle networks 106 as utilized by the ECUs 104 for ECU-to-ECU communication. In the illustrated network architecture 400, each reporting subsystem 202 is illustrated as being connected to the same vehicle bus 106 (e.g., CAN bus) as its associated ECU 104.

The network architecture 400 also includes a network router 402 configured to bridge the vehicle buses 106 to facilitate communications between the reporting subsystems 202 of the ECUs 104 and the telematics control unit 108. For example, the network router 402 may be configured to identify which vehicle bus 106 is connected to a destination of a received message, and forward the received message onto the appropriate vehicle bus 106. Using the network architecture, the telematics control unit 108 may be configured to request the data reporting subsystems 202 of the vehicle ECUs 104 to provide the packaged vehicle data 306 to the telematics control unit 108. The telematics control unit 108 may accordingly collect the packaged vehicle data 306 into data streams 110, and provide the data streams 110 to the vehicle information server 114.

Figure 5:
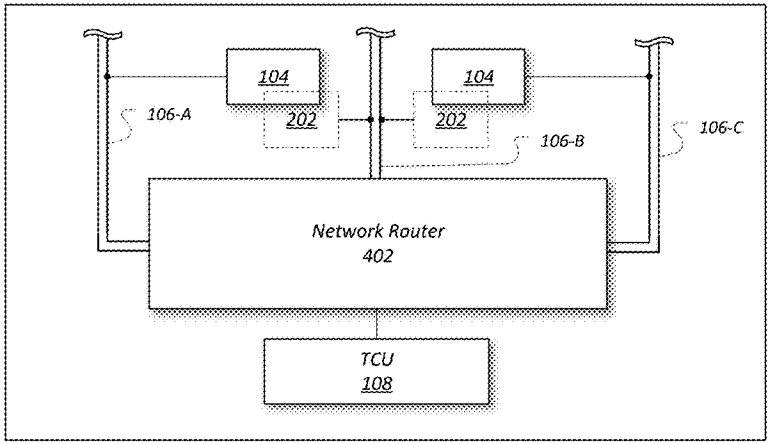
FIG. 5 illustrates an example diagram of a network architecture for the vehicle including data reporting subsystems utilizing a separate reporting vehicle network from the vehicle networks utilized by the electronic control units.

FIG. 5 illustrates an alternate example diagram of a network architecture 500 for the vehicle 102 utilizing a separate reporting vehicle bus 106 from the vehicle bus 106 utilized by the ECUs 104. As compared to the network architecture 400, in the network architecture 500 the reporting data traffic is not provided across the same vehicle bus 106 as utilized for ECU-to-ECU communication. By utilizing a separate vehicle bus 106 for the reporting subsystems 202, the network architecture 500 may alleviate concerns with additional bandwidth usage required to support additional data transmission within the vehicle 102 to provide for telematics control unit 108 collection of the packaged vehicle data 306 for reporting into data streams 110.

Figure 6:
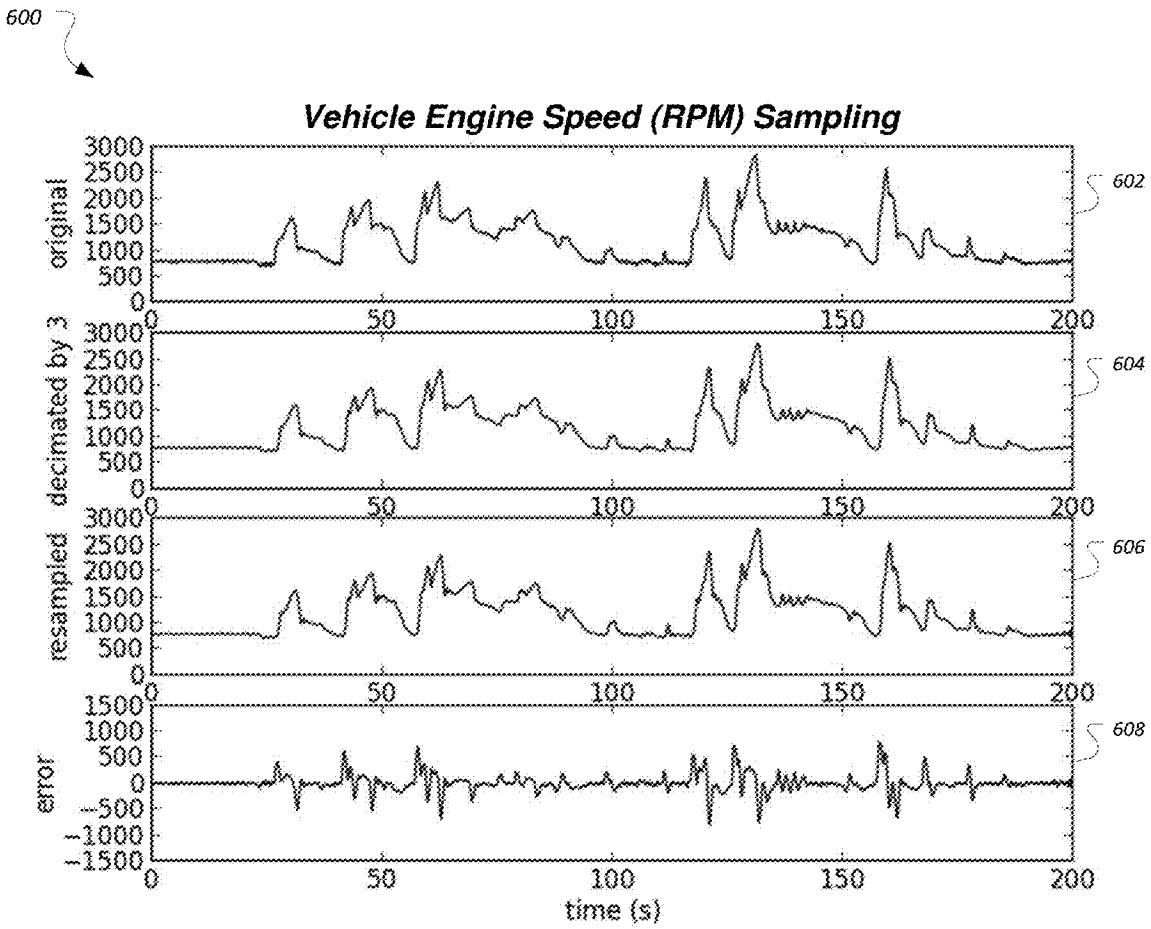
FIG. 6 illustrates an example of a reporting application compressing raw parameters into processed parameters for reporting.

FIG. 6 illustrates an example 600 of a reporting application 204 compressing raw parameters 302 into processed parameters 304 for reporting. In the illustrated example 600, a data stream 602 of engine revolutions per minute (RPM) is shown as an original raw parameter 302 provided by an engine controller ECU 104, a reduced data stream 604, a resampled data stream 606 version of the reduced data stream 604, and an error data stream 608 illustrating the difference between the resampled data stream 606 and the original data stream 602. As one possibility, the engine controller ECU 104 may be configured with a reporting application 204 configured to perform the illustrated compression to convert the engine RPM raw parameter 302 (i.e., original data stream 602) into the processed engine RPM parameter 304 (i.e., reduced data steam 604). The reporting application 204 or the ECU 104 may be further configured to store the reduced data stream 604 in the vehicle data buffer 206 for transmission via the vehicle bus 106 to the telematics control unit 108, and offloading from the vehicle 102 to the vehicle information server 114.

As illustrated, the reduced data stream 604 is decimated by a factor of three. Decimation generally refers to a process of reducing a sampling rate of a data stream, in which the data stream may be low-pass filtered and then samples from the data stream may be discarded. The decimation factor may refer to the ratio of the input rate to the output rate, where the decimation factor M is defined such that input rate/output rate=M. Accordingly, the reduced data stream 604 may include one sample for every third sample of the original data stream 602.

The resampled data stream 606 may include the data of the reduced data stream 604 resampled back up to the rate of the original data stream 606. However, as some information was lost due to the lossy compression (i.e., decimation) performed to reduce the amount of data of the original data stream 602 into the reduced data stream 604, there may be some level of error in the resampled data stream 606. The error data stream 608 accordingly illustrates this amount of lost information. Notably, the amount of error in the illustrated example 600 may be acceptably low for many reporting and diagnostic purposes, while conserving vehicle 102 and network bandwidth in the data transmission.

Figure 7:
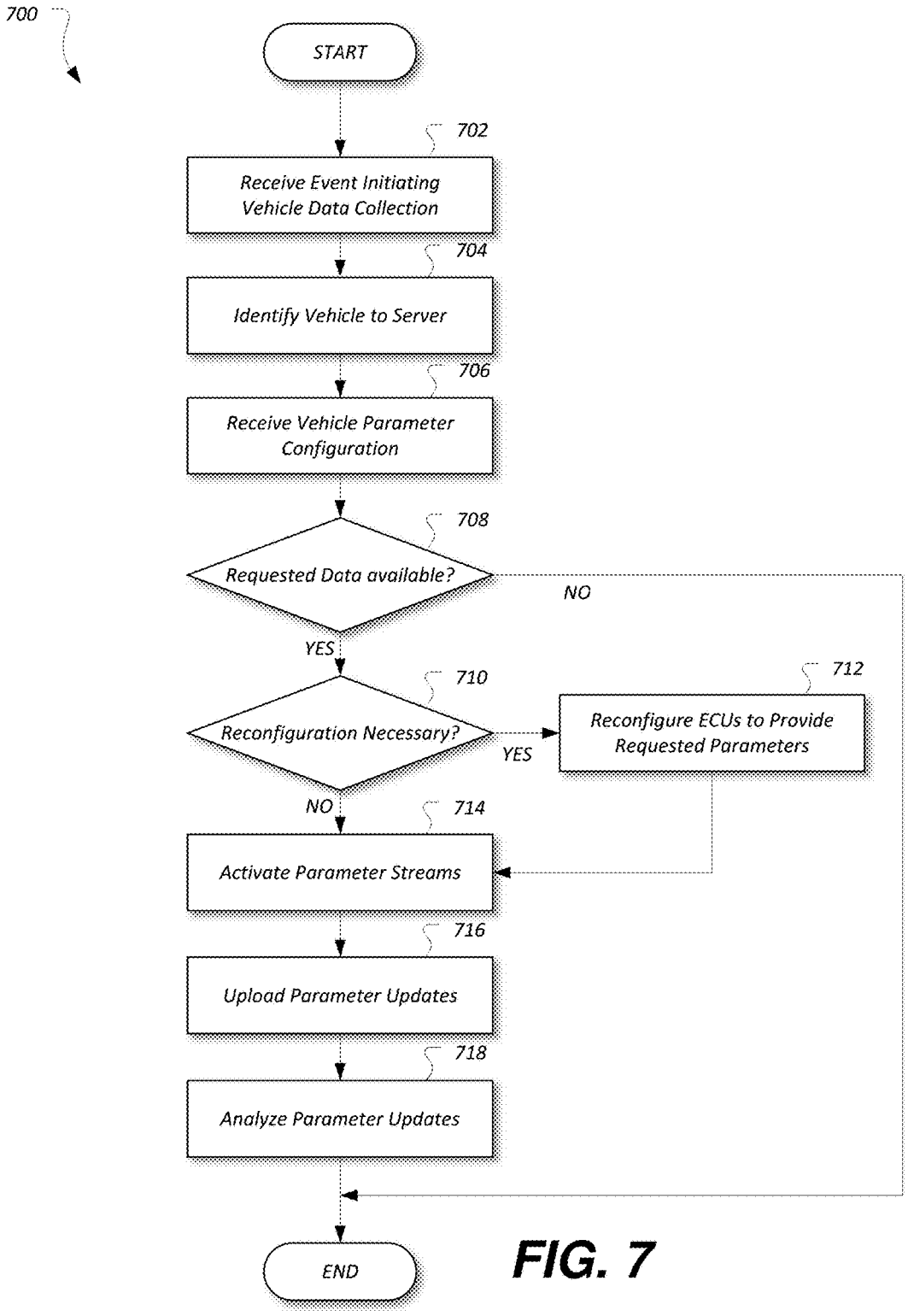
FIG. 7 illustrates an example process for facilitating efficient, automatic, reconfigurable vehicle data processing and uploading.

FIG. 7 illustrates an example process 700 for facilitating efficient, automatic, reconfigurable vehicle data processing and uploading. The process 700 may be performed, for example, by the vehicle 102 in communication with the vehicle information server 114 over the network 112. The process 700 may be initiated by various events which may be internal to the vehicle 102 or received by the vehicle 102 from an external source.

At operation 702, the vehicle 102 receives an indication of triggering of an event external to the vehicle 102. In an example, the vehicle 102 may receive a reporting request from the vehicle information server 114 requesting that the vehicle 102 provide data streams 110 including information specified by the parameter definitions 116 indicated by the reporting request. In another example, the vehicle 102 may receive a reporting request from a vehicle 102 occupant requesting that the vehicle 102 provide certain information from the vehicles ECUs 104 as indicated by the request. In yet another example, the vehicle 102 may detect occurrence of an event, responsive to which the vehicles 102 should provide certain parameter definitions 116 indicated by the generated event.

At operation 704, the vehicle 102 provides a vehicle 102 identifier in response to the event. In an example, the vehicle 102 may send a VIN of the vehicle 102 to the vehicle information server 114 to request the vehicle information server 114 to provide parameter definitions 116 for reporting for the vehicle 102. Based on the received vehicle 102 identifier, the vehicle information server 114 may be configured to identify the parameter definitions 116 compatible with the ECUs installed to the vehicle 102.

At operation 706, the vehicle 102 receives parameter definition 116 from the vehicle information server 114. For example, based on the determination of compatible parameter definitions 116, the vehicle information server 114 may identify one or more parameter definition 116 to provide to the vehicle 102. In an example, the parameter definition 116 from the vehicle information server 114 may describe the processed parameters 304 to be provided by the vehicle 102 as a unique identifier of the processed parameters 304. In another example, the parameter definition 116 from the vehicle information server 114 may describe the processed parameters 304 to be provided by the vehicle 102 as a reporting application 204 to be installed to a vehicle ECU 102 to receive raw parameters 302 and compute the processed parameters 304.

At operation 708, the vehicle 102 determines whether the requested data is available. In an example, the telematics control unit 108 of the vehicle 102 may query the ECUs 104 to determine whether the ECUs 104 of the vehicle 102 are capable of providing the raw parameters 302 required to produce the processed parameters 304. If the ECUs 104 report that the raw parameters 302 are unavailable to be provided by the installed vehicle 102 ECUs 104, the process 700 ends. Otherwise, control passes to operation 710.

At operation 710 the vehicle 102 determines whether reconfiguration is necessary to provide the requested data. In an example, the telematics control unit 108 of the vehicle 102 may query the ECUs 104 to determine whether the ECUs 104 are configured to process the raw parameters 302 into the processed parameters 304 specified by the parameter definitions 116. If one or more ECUs require reconfiguration, control passes to operation 712. Otherwise, if the ECUs 104 are properly configured, control passes to operation 714.

At operation 712, the vehicle 102 reconfigures the data streams 110. In an example, the telematics control unit 108 may request the out-of-date ECUs 104 to update their reporting applications 204 to process the raw parameters 302 into the processed parameters 304 in accordance with one or more reporting applications 204 included within or otherwise specified by the parameter definitions 116.

At operation 714, the vehicle 102 activates the data streams 110. In an example, the ECUs 104 may utilize their respective reporting applications 204 to process the raw parameters 302 into the processed parameters 304. The reporting applications 204 may accordingly provide the processed parameters 304 to the vehicle data buffers 206 associated with the ECUs 104.

At operation 716, the vehicle 102 uploads the data. In an example, the telematics control unit 108 may be programmed to periodically collect the packaged vehicle data 306 from the vehicle data buffers 206 associated with the ECUs 104, and provide the data as data streams 110 to the vehicle information server 114 over the communications network 112.

At operation 718, the vehicle information server 114 analyzes the data. For example, the vehicle information server 114 may support querying of the maintained data streams 110 to provide data processing and other features to users of the vehicle information server 114. After operation 718, the process 700 ends.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle system comprising:

a vehicle electronic control unit (ECU) controlling a vehicle subsystem and configured to receive from a remote server via a vehicle telematics unit (TCU), a parameter definition specifying processing to be used by the ECU to generate a processed parameter from a raw parameter generated by the ECU, wherein the processed parameter is a down-sampled version of the raw parameter;

generate the processed parameter according to the parameter definition based on the raw parameter; and send the processed parameter to a vehicle data buffer associated with the ECU for upload to the remote server via the TCU.

2. The system of claim 1, wherein the down-sampling is performed according to decimation.

3. The system of claim 1, wherein the ECU is connected to communicate messages with a plurality of other ECUs over a first vehicle network, and the vehicle data buffer associated with the ECU is configured to send the processed parameters to the TCU over a second vehicle network.

4. The system of claim 1, wherein the parameter definition includes a unique identifier of the processed parameter.

5. The system of claim 1, wherein the parameter definition includes a reporting application configured to be executed by a processor of the ECU to generate the processed parameter from the raw parameter.

6. A vehicle system comprising:

a plurality of electronic control units (ECUs), each configured to generate processed parameters from raw parameters according to processing specified by received parameter definitions;

a telematics control unit (TCU) configured to provide a data stream of the processed parameters to a remote server; and a plurality of vehicle data buffers, each configured to receive the processed parameters from the plurality of ECUs and send the processed parameters to the TCU over a dedicated data-reporting vehicle network, wherein the plurality of ECUs are configured to generate the processed parameters based on raw parameters generated by the plurality of ECUs, and at least one of the processed parameters is a down-sampled version of one of the raw parameters.

7. The system of claim 6, wherein the down-sampling is performed according to decimation.

8. The system of claim 6, wherein the parameter definition includes a reporting application configured to be executed by a processor of one or more of the plurality of ECUs to generate the processed parameter from the raw parameter.

9. The system of claim 6, wherein the parameter definition includes a unique identifier of the processed parameter.

10. A computer-implemented method comprising:

generating a processed parameter as a down-sampled version of a raw parameter according to a parameter definition received from a remote server via a vehicle telematics unit (TCU) and specifying processing performed to a the raw parameter generated by an electronic control unit (ECU) to generate the processed parameter; and sending the processed parameter to a vehicle data buffer associated with the ECU for upload to the remote server via the TCU.

11. The method of claim 10, further comprising performing the down-sampling according to decimation.

12. The method of claim 10, further comprising:

communicating messages between the ECU and a plurality of other ECUs over a first vehicle network, and sending the processed parameters from the vehicle data buffer associated with the ECU to the TCU over a second vehicle network.

13. The method of claim 10, wherein the parameter definition includes a unique identifier of the processed parameter.

14. The method of claim 10, wherein the parameter definition includes a reporting application configured to be executed by a processor of the ECU to generate the processed parameter from the raw parameter.

15. The system of claim 1, wherein the parameter definition includes software code configured to be executed by a processor of the ECU to generate the processed parameter from the raw parameter.

16. The system of claim 6, wherein the parameter definitions include software code configured to be executed by a processor of one or more of the plurality of ECUs to generate the processed parameter from the raw parameter.

17. The method of claim 10, further comprising updating a memory of the ECU according to the parameter definition that is received by the ECU, the parameter definition including software code configured to be executed by a processor of the ECU to generate the processed parameter from the raw parameter.

* * * * *